US005626329A

United States Patent [19]

Herdan

[11] Patent Number: 5,626,329

[45] Date of Patent: May 6, 1997

[54] SUCTION OPERATED CARPET LAYING DEVICE

[76] Inventor: Ralph Herdan, 4 Hillside View, New Mills, Stockport, Cheshire SK123DF, Great Britain

[21] Appl. No.: 370,242

[22] Filed: Jan. 9, 1995

[51] Int. Cl.[6] ..... B25B 25/00; B65H 77/00

[52] U.S. Cl. ..... 254/200; 294/8.6; 414/752

[58] Field of Search ..... 254/200, 201, 254/204, 205, 206, 207, 209; 294/8.6; 38/102.91, 102.8; 112/7, 8; 414/752

[56] References Cited

U.S. PATENT DOCUMENTS

| | | | |
|---|---|---|---|
| 431,488 | 7/1890 | Sack | 254/205 |
| 3,178,155 | 4/1965 | Bird | 254/62 |
| 4,084,787 | 4/1978 | Kowalczyk | 254/201 |
| 4,571,320 | 2/1986 | Walker | 414/752 X |
| 4,720,227 | 1/1988 | Eberle | 414/752 X |
| 5,255,894 | 10/1993 | Guarneri | 254/200 |
| 5,409,767 | 4/1995 | Trudeau et al. | 414/752 X |

*Primary Examiner*—Daniel P. Stodola
*Assistant Examiner*—Emmanuel M. Marcelo
*Attorney, Agent, or Firm*—Robert W. J. Usher

[57] ABSTRACT

A carpet laying device comprises an anchor unit, a mobile unit and a drive system. The mobile unit and the anchor unit are secured to the carpet by suction provided by electrically driven exhaust fans. In use, the mobile unit is driven by the drive system away from the anchor unit to smooth out or stretch the carpet, the friction between the carpet and the mobile unit being weaker than that between the carpet and the anchor unit. In an alternative device, the anchor unit is a cushioned pad for abutment with a wall.

20 Claims, 4 Drawing Sheets

SUCTION OPERATED CARPET LAYING DEVICE

FIELD OF THE INVENTION

This present invention relates to a device for assisting laying of carpets and other like floor coverings.

BACKGROUND OF THE INVENTION

When a wall-to-wall carpet is installed, a major problem is stretching it so that it lies flat prior to anchoring it over spiked "grippers" around the periphery of the room. The difficulty is that there is no vantage point outside the area to be covered from which the carpet can be pulled taut, and the operator has to work while positioned on the carpet itself. He has somehow to maneuver the carpet while it is bearing his weight.

There are two standard approaches to the problem. The more usual one, largely for the smaller domestic situation, involves the use of a "kicker". This is a metal rod bearing at one end a pad equipped with an array of slanted spikes, usually of adjustable length, and at the other a cushioned pad at right angles to the rod's length.

The operator kneels on the carpet with one knee, and with the spikes engaged in the carpet, delivers a series of vigorous kicks against the cushioned pad with the other, so that the carpet is progressively pushed away from him towards the wall. Moving the carpet therefore requires that the frictional resistance of the carpet with the floor, produced not only by the weight of the carpet itself but also by the operator's own weight, be overcome, in addition to dragging the weight of the carpet itself.

It is well known in the trade that, use of a "kicker" is hard on the knee-and-hip joints of carpet installers, and that this tends eventually to terminate their activity in this industry at a relatively early age.

An alternative procedure, used mainly for larger installations, is to drive the spiked pad by slowly applied thrust against a counterabutment formed by a wall, using a hydraulic or mechanical thrusting device and a suitable assembly of thrust-bearing extension rods. This has the disadvantage of being cumbersome and of dependence on the structural strength of the opposing wall.

SUMMARY OF THE INVENTION

The present invention seeks to ameliorate one or more aspects of such problems by providing alternative carpet laying devices.

Accordingly, the present invention provides a carpet laying device and method in which the carpet is progressively drawn to a taut condition by applying suction to a portion of a surface thereof and progressively moving the suction applying device away from an anchored edge of the carpet.

Whilst, in principle, it may be possible to move the suction applying device manually, the forces and distances involved usually make this impractical or inefficient.

Accordingly, a carpet laying device comprises means for securing the device with respect to a carpet, suction means for engaging the carpet, and means for advancing the engaging means over the carpet away from the securing means to draw the carpet taut, thereby smoothing out or stretching the carpet.

Embodiments of the present invention have numerous advantages. In particular, use of suction to stretch or smooth out the carpet overcomes various problems associated with prior proposals. For example, the impulsive and rather violent local stretching action of the traditional procedure is typically replaced by a gentler continuous stretching and ironing action with less likelihood of damage to the carpet. Also, cumulative long-term damage to the operators' knee and hip joints, characteristic of the traditional technique, would be avoided. Indeed, typically, little physical effort would be required of the operator.

In one embodiment, for example when a wall cannot be relied on for support, possibly in a partitioned building, the securing means are also operable by suction. It is also desirable for the carpet layer to have means for adjusting suction strength of the engaging means and, if appropriate, the securing means. This can increase adaptability and versatility of the device since different suction strengths may be appropriate for different weight/size carpets. Suitably, appropriate suction is provided by electrically driven exhaust fans. If desired, fans may be associated with both the securing means and the engaging means.

Conveniently, the engaging means and/or securing means comprise a hollow dome. Preferably, the engaging means has a relatively low friction surface for contacting the carpet and for easing advance of the engaging means thereover. Suitable preferred low friction surfaces comprise polished metal.

Similarly, preferably the securing means has a relatively high friction surface for contacting the carpet to assist anchorage of the securing means thereto. A preferred example of high friction surfaces comprises rubber gaskets.

It is also preferable for the securing means to be larger and/or heavier than the engaging means.

Suitably the engaging means and/or securing means include filters to resist passage of carpet debris or the like into the device.

It is also preferable for the engaging means and/or securing means to include lower, carpet engaging perforated barriers spaced from the upper, exhaust fans or other suction means and spanning the suction inlet, to inhibit distortion of the carpet.

Preferably, the engaging means is provided with a switch for activating the drive or advancing means and/or the supply of suction. Suitably the switch is arranged for operation to deactivate the drive or advancing means and/or the engaging means when the engaging means abuts a wall or other obstacle to prevent advancement of the engaging means.

Preferably, the advancing means is electrically driven by a fractional horsepower motor, (possibly 0.25 Kw, although this would depend on carpet weight and effective permeability) through a suitable reduction gear such as a worm drive. Preferred embodiments of the present invention include a track with the securing means being fixedly mounted to the track and the engaging means releasably mounted thereto. Means are also provided for driving the engaging means along the track, so as to advance over the carpet. Preferably, the track is toothed, suitably made of light alloy or plastic. Also, in particularly preferred embodiments, the driving means includes a pinion for engagement with such a toothed track. Conveniently, the pinion is made of plastics.

According to another aspect of the invention, a method of laying a carpet in a room includes the steps of:

a) securing one edge of the carpet to a floor of the room adjacent one wall of the room with a remainder of the carpet extending in slack condition across the floor toward another wall of the room, opposite the one wall;

b) applying suction to a portion of a surface of the remainder of the carpet and progressively advancing the suction across the surface away from the one edge toward another edge of the carpet, opposite the one edge and adjacent the opposite wall, thereby drawing a portion of the carpet between the one edge and the suction into a taut condition;

c) securing a part of the opposite edge of the carpet to the floor adjacent the opposite wall; and, repeating steps b) and c) for different portions of the remainder of the carpet until the entire opposite edge of the carpet has been secured to the floor with the remainder of the carpet lying flat, thereon in taut condition.

A prototype powered by an electric motor obtained from a domestic vacuum cleaner and provided with a speed controller for regulation of suction has performed effectively, providing very strong adhesion.

BRIEF DESCRIPTION OF THE DRAWINGS

Specific embodiments of the present invention will now be described by way of example, with reference to the accompanying drawings in which.

DESCRIPTION OF PARTICULAR EMBODIMENTS

Figure 1A:
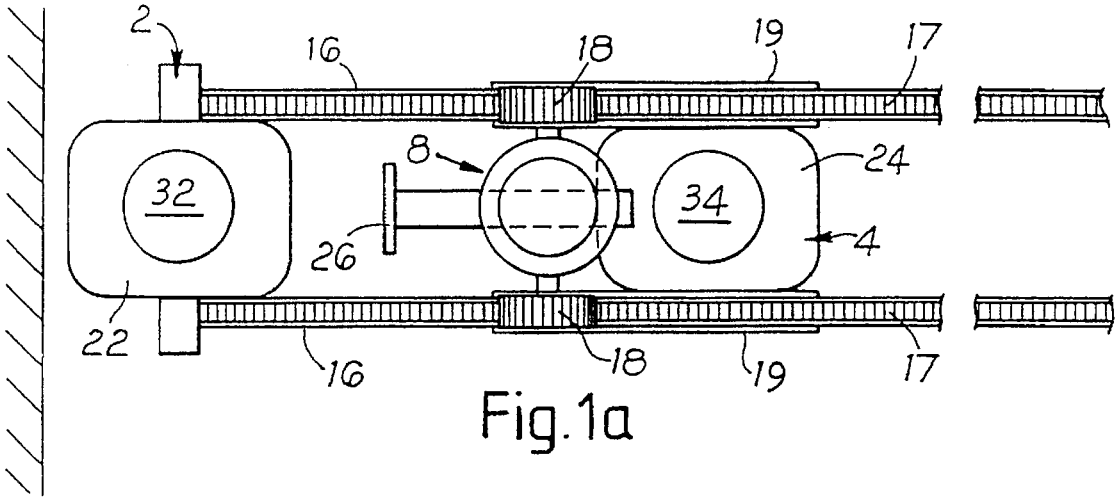
FIG. 1*a* is a schematic plan view of a first embodiment of a carpet laying device.
Figure 1B:
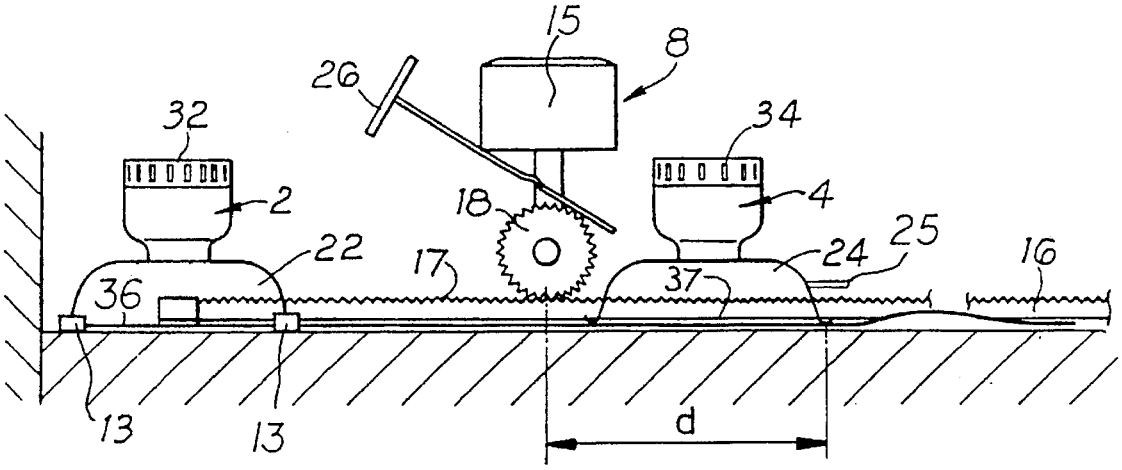
FIG. 1*b* is a schematic side elevation of the first embodiment.
Figure 2:
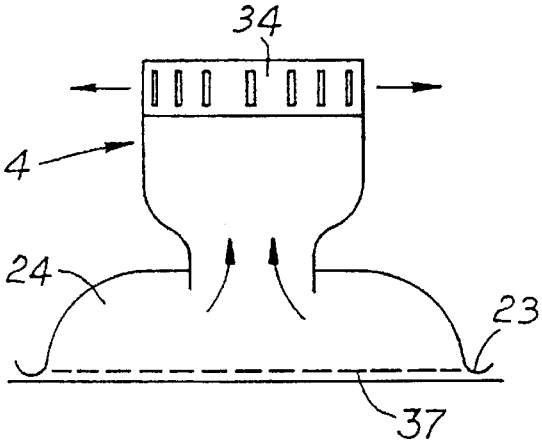
FIG. 2 is a schematic side elevation showing an engaging means in more detail.
Figure 3:
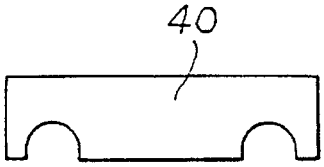
FIG. 3 shows an accessory bridge for the first embodiment.

As shown in FIGS. 1–3, the first embodiment consists essentially of three components (see FIG. 1): a securing means or anchor unit 2, a carpet engaging means or mobile unit 4 and means for advancing the carpet engaging means or drive system 8. Both the anchor unit and the mobile unit include rigid domes 22, 24 held in contact with the carpet by suction provided by exhaust fans 32,34 mounted therein.

The fans are essentially identical with those of domestic vacuum cleaners. For a dome covering O.IM$^2$ and a pressure difference of 0.1 bar, the theoretical atmospheric suction load applied to the carpet will be 100 kgf, although the actual pressure difference (and, therefore, carpet loading) depends on the power of the exhaust fans, porosity of the carpet and leakage around the rim, and can be controlled via the motor speed or by means of a regulated leak valve mounted on a dome (not shown).

The domes 22,24 are provided with lower, carpet engaging, rigid perforated barriers 36,37 formed by plastic coated wire, (see FIG. 2), spaced from upper exhaust fans 32,34 to prevent the carpet from being partially drawn into the domes 22,24 and distorted by the effect of suction. The mobile dome 24 has a rim 23 formed of polished metal with a straight leading edge. Its perforated barrier 37 is of suitable low friction material. U-section guides 19 are mounted to opposite sides of the mobile unit 4 which rigidly attached to the drive system by a framework (not shown). The anchor unit 2 has a rim 13 sealed by a gasket of a suitable elastomer and the perforated barrier 36 is rough to provide frictional contact with the carpet. Additionally, carpet gripping spikes (not shown) can be provided thereon.

The mode of operation is simple. The anchor unit 2 is placed against a wall against which the edge of the carpet had previously been secured over the spiked grippers in the usual way, and the mobile unit 4 is placed adjacent the anchor unit 2 in the carpet stretching direction. The exhaust fans 32,34 are then switched on and the mobile unit 4 is then driven forward away from the anchor unit 2 by the drive unit system described in more detail below.

The two units 2,4 lie between two parallel lengths of rail 16, (which are of tubular construction to combine stiffness with lightness), each of which is provided with a toothed rack 17 on an uppermost surface. The rails 16 are latched onto the anchor unit 2 but extend over the U-section guides 19 on opposite sides of the mobile unit 4 to permit relative sliding movement therewith. A low power motor 15 of the drive means, carried by the mobile unit 4 drives pinion wheels 18 through a reduction gear train, which pinion wheels mesh with the racks thereby driving the mobile unit forward along the rails. The friction between the carpet and the mobile unit 4 is insufficient to overcome the adhesion of the anchor unit 2. In an alternative embodiment, the anchor unit 2 can be larger to secure greater atmospheric loading, as well as relying on the additional friction already referred to.

As the mobile unit 4 is driven forward, the length of carpet between the two units 2, 4 would be stretched taut by the frictional force resisting the drive. At the same time, any existing undulations in the carpet would be driven ahead of the leading edge in an action somewhat similar to 'ironing'. With power off, the suction unit can be returned to the initial wall, and the track slid laterally by hand to a new position for another pass. As a result of the much larger area covered by the suction unit than the mere fist sized area covered by a typical knee kicker, far fewer passes are required and each are completed in a small fraction of the time, providing a very substantial increase in the speed of carpet laying.

The thrust tubes or rails 16 are assembled from only two standard lengths snapped together by a suitable locking mechanism. For example, there could be 2 meter and 1 meter lengths so that, in traversing the floor, there would be a deficit of at most 1 meter length.

The distance d) indicated in FIG. 1*b*, between the drive pinion 18 and the leading edge of the mobile unit 4 is 1 meter, enabling a floor of virtually any dimension to be accommodated exactly. The mobile unit 4 is provided with a contact switch 25 to stop its progress on encountering the opposing wall and a control handle 26 optionally to be held by the operator walking behind it between the thrust tubes.

For lightness and portability, the thrust tubes or rails 16 are made of light alloy or, alternatively, suitable plastic of high strength and stiffness. The pinion wheels 18 are nylon, for example, to avoid the need for lubricants which could be undesirable in such an application.

The design would preferably allow for easy assembly of the thrust tubes or rails 16 and their engagement with the anchor and mobile units 2,4 by snap fitting them into place from the side, once the assembled tube form rails had been laid side-by-side on the floor.

It would be an easy matter to manufacture the apparatus described in a range of sizes to suit different sized installations varying from the domestic to the large commercial contract. The thrust tubes 16 would, of course, have to be appropriately scaled to obviate the possibility of buckling at the maximum anticipated length. Because of the weight of the thrust tubes 16, the most likely onset of buckling would be in the horizontal plane, and the effective length could therefore, if necessary, be extended by placing suitable 'bridges' 40 across the thrust tubes at appropriate intervals behind the mobile unit as it progressed (see FIG. 3). Portability could be assured by the fact that the major components would be assembled and disassembled in situ.

Figure 4:
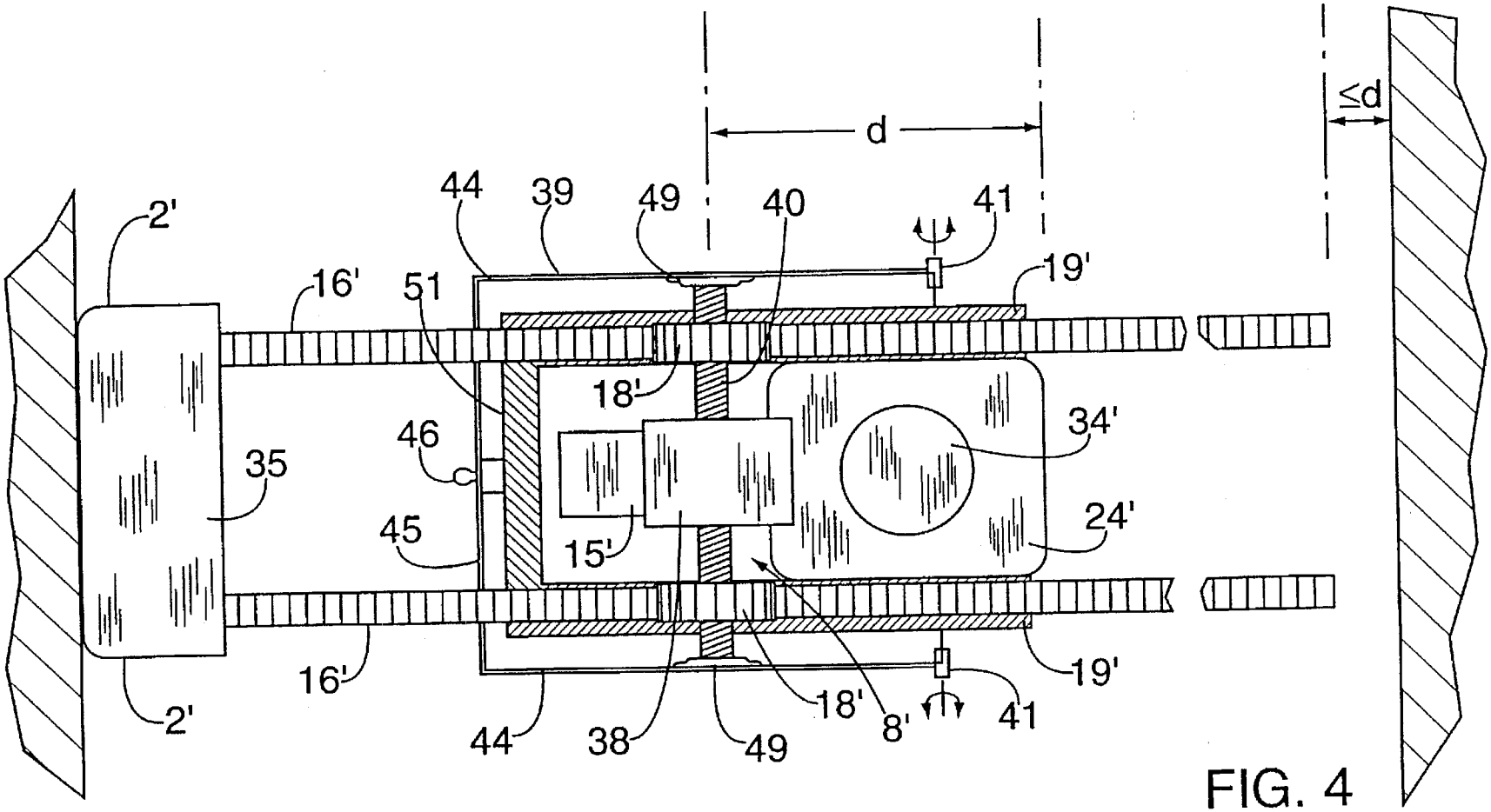
FIG. 4*a* is a schematic plan view of a second embodiment of a carpet laying device.
FIG. 4*b* is a schematic side elevation of the second embodiment, partly broken away
Figure 5:
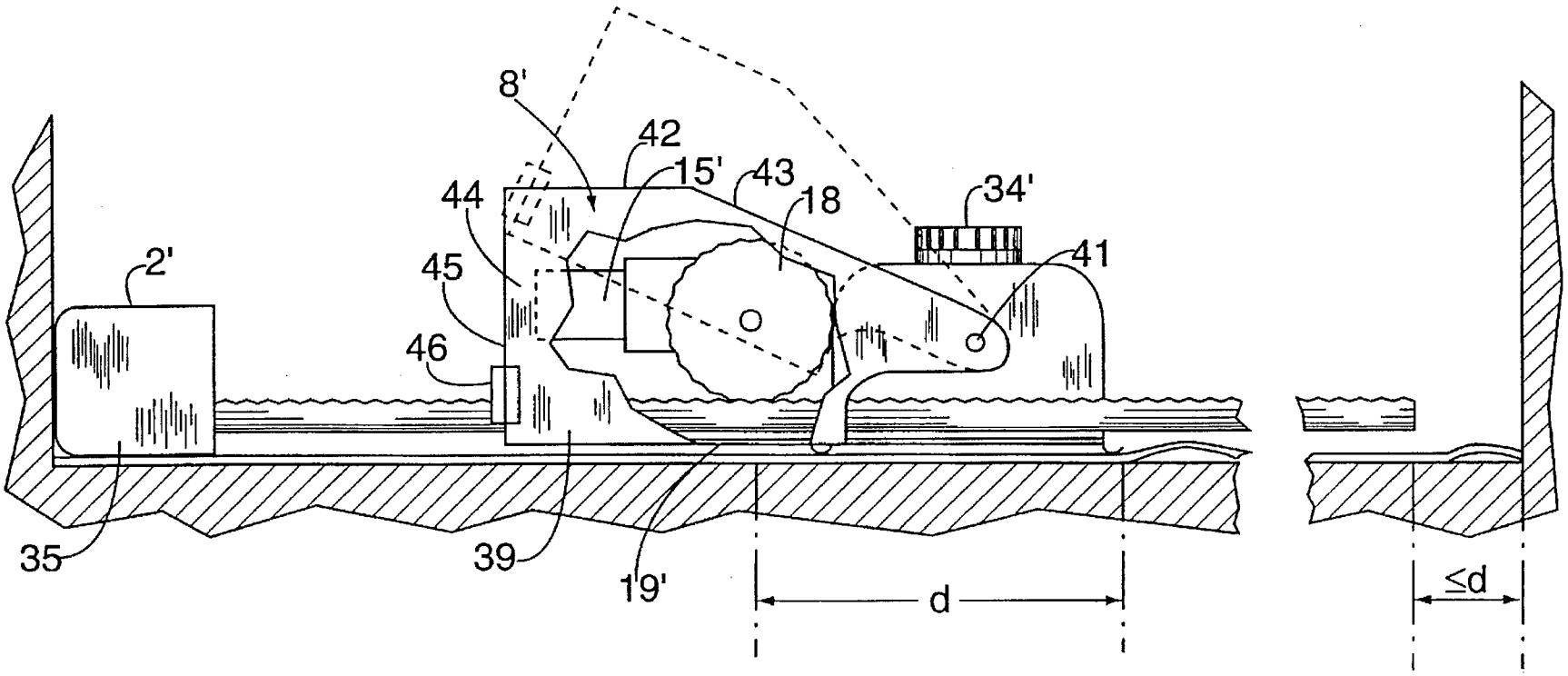
FIG. 5 is a schematic front view of the second embodiment.
Figure 6:
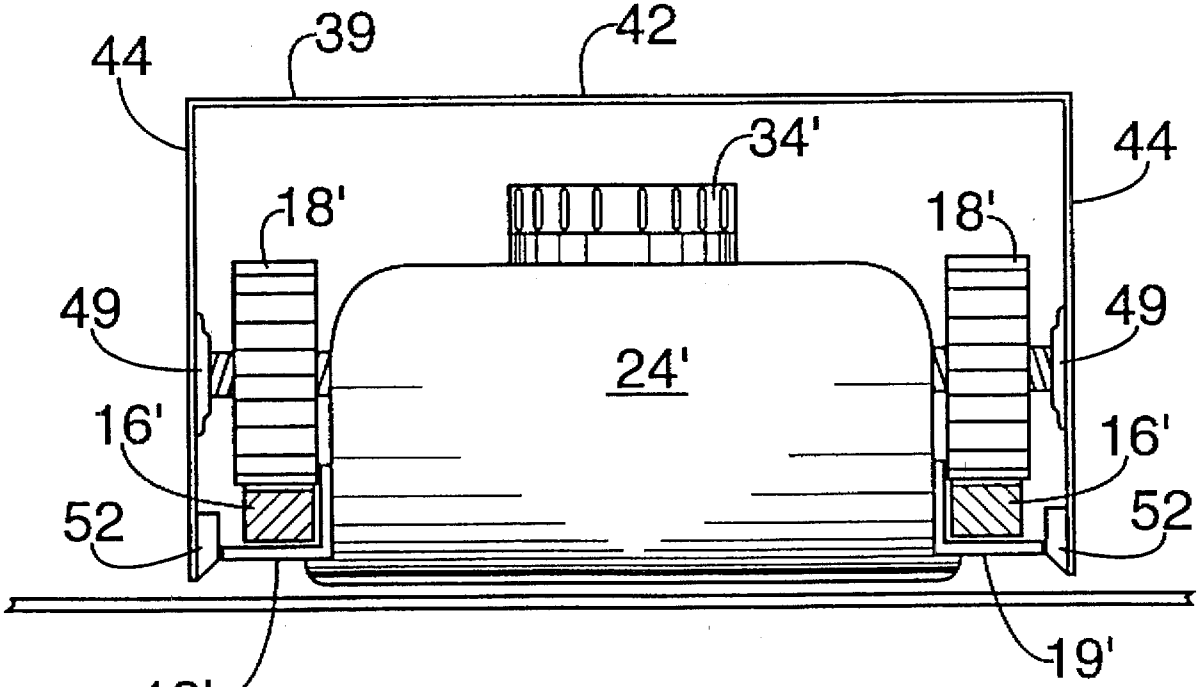

In the second embodiment, shown in FIGS. 4–6, similar parts to the first embodiment are indicated by primed references. The principle modifications are the substitution of a cushioned detachable cross member 35 for the suction device of the anchoring unit 2 and the mounting of the drive system, including the motor 15', gearbox 38, drive shaft 40 and pinion or drive sprocket 18 on a rigid sheet metal casing 39 which is pivotally mounted by trunnions 41 to opposite sides of the dome 24' of the engaging unit to enable the drive system 8' to be swung upward for assembly with the rails prior to use and then released to bring the pinion gear 18' into and out from driving engagement with the rails 16'.

The casing 39 has an upper transverse wall 42, (not shown in FIG. 4, for clarity), with a forward portion 43 canted downward toward the pivotal mounting 41, side walls 44 depending from opposite lateral edges of the upper wall 42 and joined by a rear wall 45. Bearings 49 carrying opposite ends of the drive shaft 40 are mounted on respective side walls 44. A catch type locking device 46 is mounted on a lower edge of the rear wall 45 for releasable locking engagement with a cross member 51, which rigidly joins the guides 19' of the pinion, in the rail engaging position. The rear wall is rebated at a lower edge portion to provide clearance for the rails.

The guides 19' are of outward facing L-shaped section and lateral guides 52 of suitable low friction material such as nylon are provided along lower edges of inner surfaces of the side walls of the casing.

In an alternative embodiment, carpet gripping spikes are combined with or substituted for the cushioning on the cross member of the anchoring unit 2.'

The mode of operation is similar to that of the first embodiment. An edge of the carpet is secured adjacent one wall by the convention spiked grippers with the remainder extending across the floor in slack condition. The suction unit is placed on the carpet adjacent the first wall with the casing pivoted to the upper position and the two lengths of track are assembled in the respective guides and laid to appropriate lengths on either side of the suction unit. The cushioned anchoring unit is then attached to adjacent ends of the rails and placed in abutment with the wall. The casing is then lowered bringing the drive pinions into driving engagement with the track, and the locking device engaged to lock the drive in the lower position. The drive motor and suction fan are then switched on driving the suction unit across the floor driving any undulations in the remainder of the carpet ahead of it and drawing the carpet into taut condition behind it. The contact switch stops the drive motor on engagement with the opposite wall but the suction remains on until the operator is ready to fasten the opposite edge of the carpet at its free end on the conventional, spiked grippers previously anchored adjacent the opposite wall.

It is anticipated that the force applied to the wall will be approximately 30N which will be distributed over a sufficiently large area by the cushioning to avoid risk of damage to a wall of conventional brick and mortar construction.

It will be appreciated that various modifications to the illustrated device are possible. It will, however, be appreciated that both embodiments have various advantages, namely:

speed, ease, and quality of installation could be substantially increased by using the present devices; instead of acting on a fist-sized area of carpet at a time, the proposed device would act on a very much larger area, and the floor would be traversed in a matter of seconds, perhaps half a minute at the most.

The impulsive and rather violent stretching action of the traditional procedure would be replaced by a gentler continuous simultaneous stretching and 'ironing' action with less likelihood of damage to the carpet.

Cumulative, long term damage to the operator's knee and hip joints, characteristic of the traditional technique would be avoided. Little physical effort would be required of the operator.

I claim:

1. A carpet laying device comprising:

track forming means having a first end and a second, opposite, end, for extending across a carpet covering a floor so that the first end and second, opposite, end are adjacent first and second, opposite, edges of the carpet, respectively;

securing means on the first end of the track forming means for securing the first end relative to the first edge of the carpet;

suction producing, engaging means for slidingly engaging the carpet by suction; and, means for advancing the engaging means along the track forming means over the carpet in continuous sliding engagement therewith from a position adjacent the first end away from the securing means to a position adjacent the second end while applying a suction force to the carpet continuously throughout such advance so that an increasing length of carpet between the engaging means and the securing means is progressively drawn taut and flat and maintained in taut and flat condition by suction produced by the engaging means.

2. A device according to claim 1 wherein the securing means are operable by suction.

3. A device according to claim 1 having means for adjusting suction strength.

4. A device according to claim 1 wherein suction is provided by an electrically driven exhaust fan.

5. A device according to claim 4 wherein electrically driven exhaust fans power both the securing means and engaging means.

6. A device according to claim 1 wherein at least one of the engaging means and the securing means comprises a hollow dome.

7. A device according to claim 6 wherein the securing means has a relatively high friction surface for contacting the carpet.

8. A device according to claim 7 wherein the relatively high friction surface comprises a rubber gasket mounted on the securing means for contacting the carpet.

9. A device according to claim 1 wherein the engaging means has a relatively low friction surface for contacting the carpet.

10. A device according to claim 9 wherein the relatively low friction surface is provided by a polished metal edge surrounding a suction inlet aperture of the engaging means.

11. A device according to claim 1 in which the suction means includes a perforated, carpet engaging barrier.

12. A device according to claim 1 wherein a contact switch is mounted to the securing means for operative engagement with a wall thereby to deactuate suction.

13. A device according to claim 1 wherein the means for advancing the engaging means are electrically driven.

14. A device according to claim 1 wherein the securing means are fixedly mounted to a track, the engaging means are releasably mounted to the track and the advancing means is arranged to drive the engaging means along the track.

15. A device according to claim 14 having at least two spaced lengths of track.

16. A device according to claim 15 wherein the track is formed with teeth and the advancing means includes a pinion operatively engageable with the teeth.

17. A device according to claim 14 wherein the track is a snap fit to the securing means.

18. A device according to claim 14 wherein the advancing means is mounted on the engaging means for upward pivotal movement to a position clear of the track.

19. A carpet laying device comprising:

track forming means having a first end and a second, opposite, end, for extending across a carpet covering a floor so that the first end and second, opposite, end are adjacent first and second, opposite, edges of the carpet, respectively;

securing means on the first end of the track forming means for securing the first end relative to the first edge of the carpet;

suction producing, engaging means for slidably engaging the carpet by suction and comprising a hollow housing having a lower, carpet engaging end provided with a carpet engaging, suction inlet aperture spanned by a perforated, carpet engaging barrier, and a suction fan mounted in the housing at a location remote from the carpet engaging end;

and, drive means operably connected to the engaging means and engaged with the track means for advancing the carpet engaging means along the track over the carpet in continuous sliding engagement therewith from a position adjacent the first end away from the securing means to a position adjacent the second end while applying a suction force to the carpet continuously throughout such advance so that an increasing length of carpet between the engaging means and the securing means is progressively drawn taut and flat and maintained in taut and flat condition by suction produced by the engaging means.

20. A method of laying a carpet in a room including the steps of:

a) securing one edge of the carpet to a floor of the room adjacent one wall of the room with a remainder of the carpet extending in slack condition across the floor toward another wall of the room, opposite the one wall;

b) applying suction to a portion of an upper surface of a remainder of the carpet at a position adjacent the one edge, and progressively advancing a point of application of the suction across the surface away from the position adjacent the one edge to another position adjacent another edge of the carpet, opposite the one edge and adjacent said another wall while continuously applying the suction throughout such advance, thereby drawing and maintaining a portion of the carpet between the one edge and the suction into a taut, flat condition;

c) securing a part of the opposite edge of the carpet adjacent said another position to the floor adjacent the opposite wall; and, repeating steps b) and c) for different portions of the remainder of the carpet until an entire opposite edge of the carpet has been secured to the floor with the remainder of the carpet lying flat, thereon in taut condition.

* * * * *